United States Patent [19]

Thomas et al.

[11] 4,308,721

[45] Jan. 5, 1982

[54] FLUID SUPPLY SYSTEMS

[75] Inventors: Alan V. Thomas; Geoffrey E. Bone, both of Crowthorne, England

[73] Assignee: Sperry Limited, Bracknell, England

[21] Appl. No.: 71,961

[22] Filed: Sep. 4, 1979

[30] Foreign Application Priority Data

Sep. 18, 1978 [GB] United Kingdom ..... 37221/78

[51] Int. Cl.[3] ..... F01B 29/00

[52] U.S. Cl. ..... 60/634; 60/325; 60/632

[58] Field of Search ..... 60/632, 634, 325

[56] References Cited

U.S. PATENT DOCUMENTS

| | | | |
|---|---|---|---|
| Re. 28,434 | 5/1975 | Olsen | 60/632 |
| 3,031,845 | 5/1962 | Ludwig | 60/632 |
| 3,040,763 | 6/1962 | Bouvier | 60/632 |
| 3,286,460 | 11/1966 | Stadler et al. | 60/634 |
| 3,656,296 | 4/1972 | Wills | 60/632 |
| 3,886,745 | 6/1975 | Kaida et al. | 60/632 |
| 3,897,173 | 7/1975 | Mandroian | 60/634 |
| 4,085,710 | 4/1978 | Savarimuthu | 60/632 |

*Primary Examiner*—Wendell E. Burns
*Attorney, Agent, or Firm*—Howard P. Terry

[57] ABSTRACT

The invention relates to a fluid supply system and seeks to provide a simpler, safer but reliable system than at present known. The fluid supply system comprises a multi-charge solid propellant gas generator and a fluid expulsion unit integrated into a single unit, the gas generator being provided in a cap (8) for a chamber (1) having a gas portion (3) and a fluid portion (2) and a movable partition (4) between these two portions operable to expel fluid from the chamber when the gas generator is rendered operative. The system also comprises ignition control means (22) operable to control the ignition of the solid propellant charges (13) when required to give a fully controllable system output.

The system can be designed for supplying under pressure fluids such as hydraulic oil, fuels, oxidants and water and is particularly useful in aerospace applications.

10 Claims, 9 Drawing Figures

Figure 1:
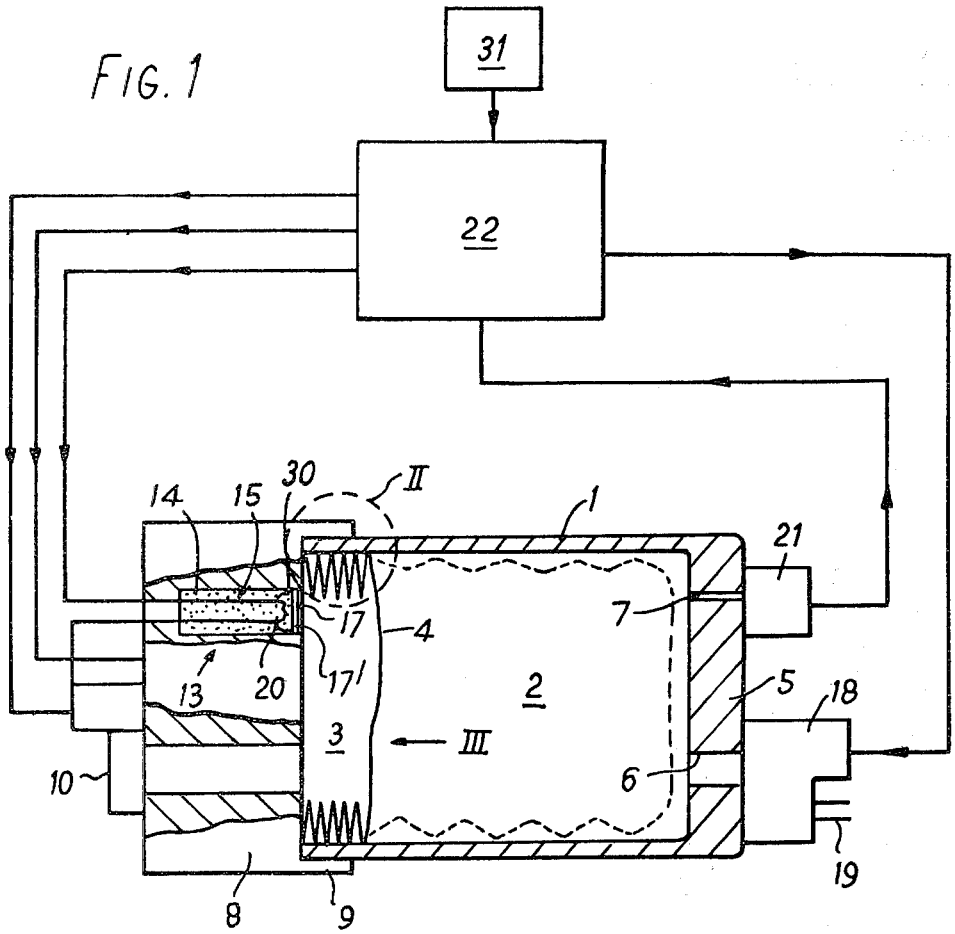

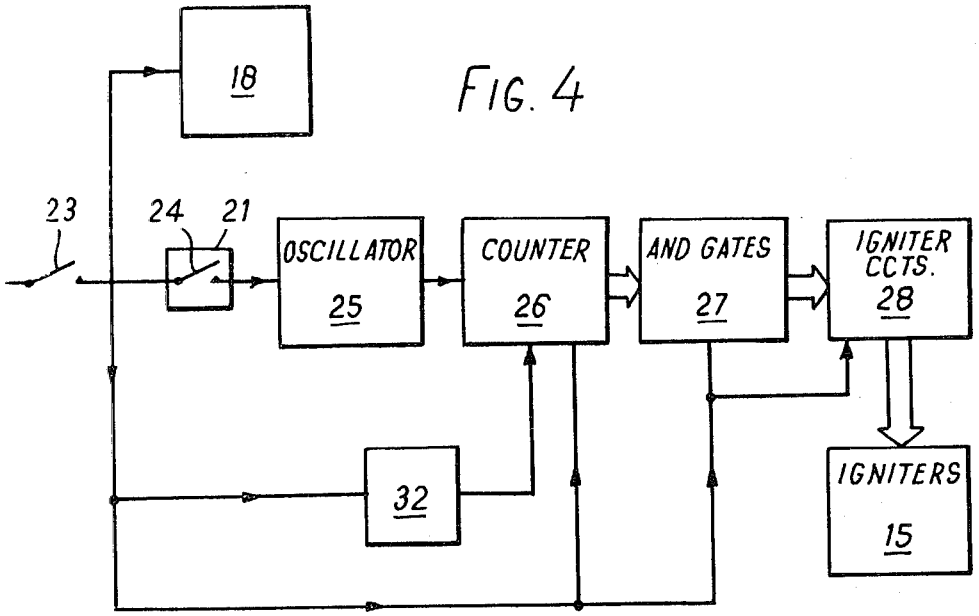
FIG. 4
FIG. 9
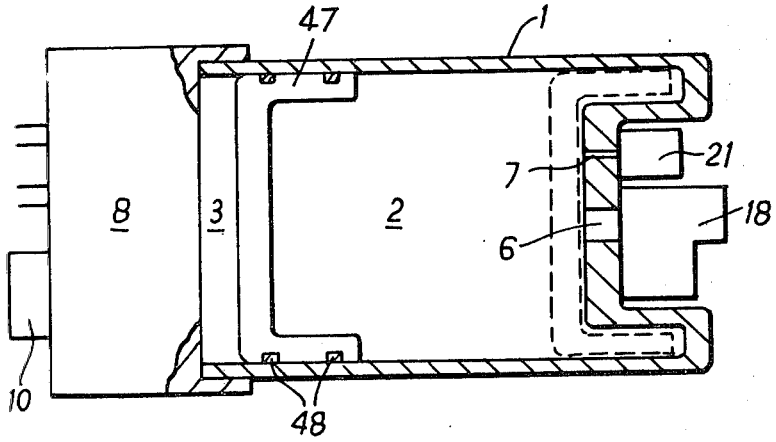

FIG. 5
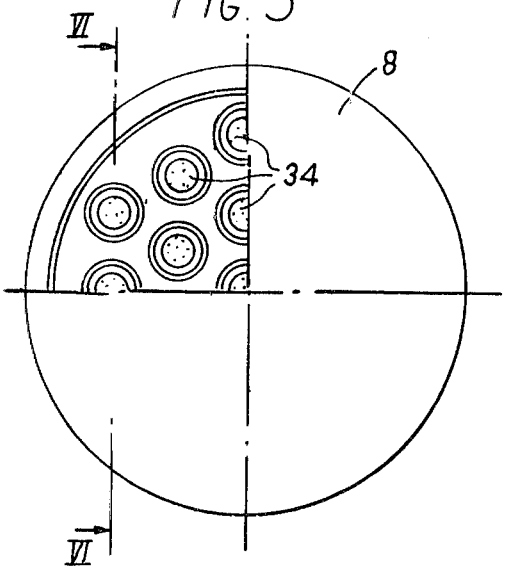
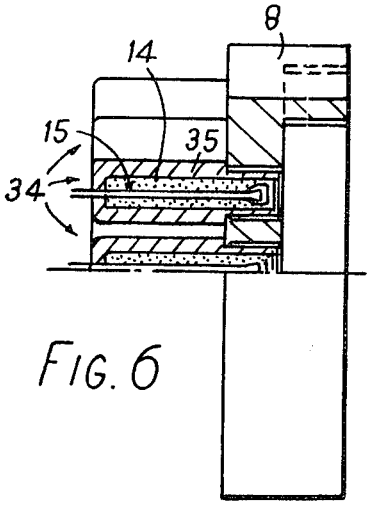
FIG. 6
FIG. 7
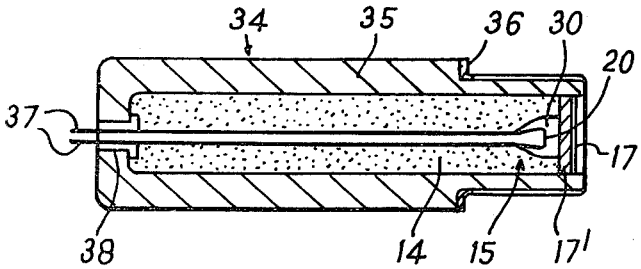
FIG. 8
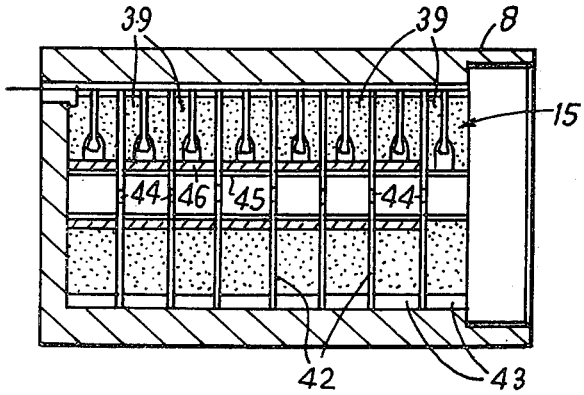

FLUID SUPPLY SYSTEMS

This invention relates to fluid supply systems such as fuel supply systems for gas generators and hydraulic fluid supply systems, for example.

A high pressure fluid source can be used to power components with a high degree of control, good response and great flexibility. Examples of such components are actuators for giving movement and position control, and fluid motors for driving mechanisms, power tools and winches. These fluid-powered components are generally lightweight and small in comparison with electric-powered or self-energised components and are, therefore, of particular use in aerospace and underwater environments. The essential pre-requisite in such applications is that the fluid source is itself lightweight, compact and reliable.

Controllable means for pressurising and expelling the working fluid from its source or reservoir is also of direct value in applications where the fluid itself must be dispensed from the reservoir to another location. Such an application is a fuel system in which the fuel must be pressurised and injected into a combustion chamber.

There are a number of known fluid supply systems which rely on a pressurised gas to pressurise and dispense the working fluid but they suffer from certain disadvantages, particularly when the fluid supply system is required for aerospace or underwater applications. One such known system utilises a stored high-pressure gas to pressurise and dispense the working fluid, the gas being contained in a gas bottle. The gas bottle is bulky and heavy and becomes increasingly so, the greater the output requirement of the system. Space and weight are two very important factors in aerospace applications and have to be kept to a minimum, whereby stored gas fluid supply systems are not compatible with this requirement. Furthermore, the gas bottle gives rise to handling and long term storage problems. Also it is difficult to integrate a gas storage container with a hydraulic oil expulsion system, for example, due to the size of the container and sealing requirements.

In another known system, the gas storage container is replaced by a gas generator which may be of the solid propellant or liquid fuel type. With the use of a solid propellant, the gas generator must be sized to meet the maximum output requirement since it is not possible to control the burning rate of a propellant once ignited in a manner to effect instantaneous increase or decrease in output. Hence, when demand is low, a large quantity of generated gas has to be dumped with the result that overall efficiency is low and a special relief valve is required which is capable of passing large quantity of a high temperature gas in a reliable manner. As regards liquid fuel gas generators, the output of these can be controlled between maximum output and about 10% output but cannot be switched off once ignited. In addition, the fuel itself, whether a monopropellant or bipropellant, has to be stored and, when required in the combustion chamber, pressurised and supplied to the latter. This creates further difficulties in terms of size and weight of the overall fluid supply system.

Another type of known fluid supply system employs a pump to supply the working fluid and the pump either has to have a capacity compatible with the required maximum flow with consequential penalties in power consumption in the motor driving the pump and heat generation, or the pump has to be fitted with a variable flow device which tends to be expensive.

The present invention seeks to provide a fluid supply system employing a solid propellant which avoids or obviates a number of the problems associated with all types of known systems.

According to the present invention a fluid supply system comprises a chamber having a portion for containing a working fluid, a portion for containing a gas for pressurising the working fluid, a movable partition separating the fluid portion from the gas portion of the chamber, an inlet for the gas and an outlet for the working fluid, the inlet being closable by a member carrying a plurality solid propellant charges, the system further comprising ignition control means for the solid propellant charges and being such that in operation a charge is ignited to produce a pressurised gas which enters the gas portion of the chamber and moves the partition in the chamber to pressurise the working fluid and expel the same through the chamber outlet, each charge being ignited as and when required.

The inlet may occupy one end of the chamber with the charge-carrying member being in the form of an end cap which may be screwed or otherwise attached in a gas-tight manner to the chamber. Each solid propellant charge may be in the form of a capsule removably attached to the charge-carrying member or end cap, or may be embodied within that member or cap. In either case, each charge is separated from the gas portion of the chamber by a frangible member which is broken on ignition of the charge to allow generated gas to enter the gas portion of the chamber but which protects the charge from inadvertent ignition following ignition of another charge. Alternatively, the solid propellant charges may be annular and stacked one next to another with an apertured member separating adjacent charges. The apertures in the separating members are preferably aligned with each other and with the bore formed by the stacked annular charges to permit generated gas to flow into the gas portion of the chamber irrespective of which charge is ignited.

The ignition control means may comprise a pressure sensor operable to sense the pressure in the gas or fluid portion of the chamber and operate switch means if the pressure is below a predetermined value, the switch means then initiating the remainder of the ignition control means. Normally, the solid propellant charges will be ignited in turn, the timing of each ignition being determined by the pressure sensor, if fitted. To effect this serial ignition of the charges, the ignition control means may comprise an oscillator operable to produce pulses, a counter operable to count the pulses generated by the oscillator and ignition circuits connected to the respective charges and energised according to the count in the counter. Means, such as the pressure sensor, may be employed to de-energise the oscillator when the pressure in the fluid portion of the chamber is at or above the required value so that the next charge is not ignited until that pressure drops below the predetermined value.

Figure 2:
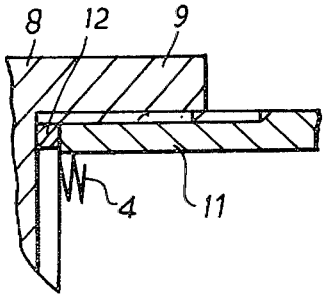
Figure 3:
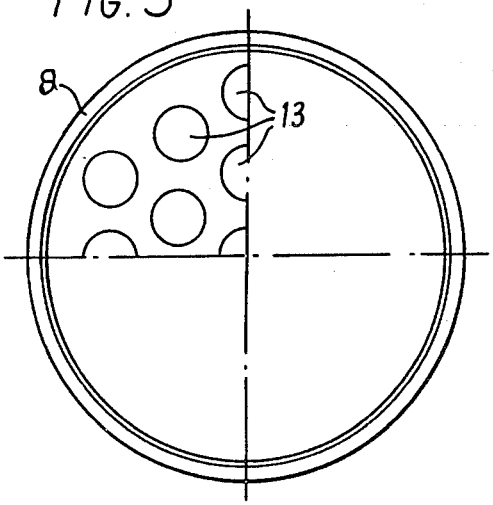

Fluid supply systems in accordance with the invention will now be described in greater detail by way of example, with reference to the accompanying drawings, in which:

FIG. 1 is a diagrammatic representation of one system in accordance with the invention, with one component shown in partial cross section, FIG. 2 is an enlarged part of a component ringed at II in FIG. 1, FIG. 3 is a partial view in the direction of arrow III of FIG. 1, FIG. 4 is block circuit diagram of a further component of FIG. 1, FIG. 5 is a view similar to FIG. 3 but of an alternative component, FIG. 6 is a section on the line VI—VI of FIG. 5, FIG. 7 is an enlargement of part of FIG. 6, FIG. 8 is a cross-section of an alternative component of FIG. 1, and FIG. 9 is a partial cross-section of a further alternative component of FIG. 1.

Referring first to FIGS. 1 to 4, the fluid supply system illustrated is designed for the supply of hydraulic fluid to actuators (not shown) on a guided missile although it will be appreciated that the system is generally applicable to other apparatus requiring a supply of high pressure fluid. The system comprises a chamber 1 having a fluid portion 2 and a gas portion 3 separated by a bellows 4 sealed at its open end to the interior wall of the chamber. The chamber 1 has a closed end 5 containing a hydraulic fluid outlet 6 and a smaller orifice 7. The opposite end of the chamber 1 is open but is closable by a cap 8 having a threaded peripheral skirt 9 which is received by a threaded portion 11 on the exterior of the chamber as seen in FIG. 2. The cap 8 is sealed in a gas-tight manner with respect to the associated end of the chamber 1 by a sealing ring 12 (FIG. 2). Mounted within the cap 8 are a plurality of solid propellant charges 13, each comprising a slug 14 of solid propellant and an igniter 15, and a pressure relief device 10 which is actuated if the pressure in the chamber gas portion 3 exceeds a predetermined value. Each charge 13 is insulated from the gas portion 3 of the chamber by a frangible member which is broken once a charge is ignited to allow gas to enter the gas portion but which otherwise prevents inadvertent ignition of a charge as a result of a neighbouring charge having been ignited. Each frangible member comprises a thin, reflective metallic disc 17 to reduce radiative heat transfer and a ceramic disc 17' to reduce conductive heat transfer although other materials can be used. FIG. 3 indicates the pattern and number of the charges 13 which can be varied depending on the required output of the system. For clarity, only one charge 13 has been shown in FIG. 1.

Each slug 14 of propellant may be cordite (41% Nitrocellulose, 50% Nitroglycerin, 9% Diethyl dipheryl urea) and may be cast, extruded, pressed or machined to shape. Each igniter 15 is of the resistance bridgewire (indicated at 20) type surrounded by a small amount of easily combustible substance 30. When a voltage is applied across the resistance bridgewire 20, the temperature of the wire increases until the easily combustible substance 30 (e.g. Boron 20% $KNO_3$ 80%) starts burning. The heat and pressure produced by this material ignites the main charge 14. The readily combustible material 30 may be dispensed with if the main charge 14 is easily ignited or if the heating effect of the bridgewire 20 is made large enough.

The hydraulic fluid outlet 6 is fitted in a sealed manner with a release valve 18 of the pyrotechnic type having an outlet 19 through the hydraulic fluid is supplied to the point of use. A pressure sensor 21 is fitted, also in a sealed manner, to the orifice 7 in the end 5 of the chamber 1 and is connected electrically to ignition control means 22 as are the release valve 18 and each solid propellant charge igniter 15, the latter through leads passing through, and sealed in, the cap 8.

Referring particularly to FIG. 4, the ignition control means 22 comprises a system initiation switch 23 connected in series with a pressure switch 24, forming part of the pressure sensor 21, and also connected to the release valve 18. The pressure switch 24 is connected to a low frequency oscillator 25 the output of which is connected to a counter 26, the output of the latter in turn being connected to a series of AND gates 27. The AND gates 27 are connected to respective igniter circuits 28 associated with individual charge igniters 15. The counter 26, AND gates 27 and igniter circuits 28 are energised on lead 29 when the initiation switch 23 is closed even though the pressure switch 24 might still be open. This also applies to the release valve 18 but not to the oscillator 25 which is only energised when both switches 23 and 24 are closed. A power supply for the various components at present under discussion is shown at 31 in FIG. 1. A monostable 32 is connected to the counter 26.

In operation of the fluid supply system of FIGS. 1 to 3, the initiation switch 23 is first closed which actuates the pyrotechnic release valve 18 to open the outlet 6 which is normally closed by the valve to prevent leakage of hydraulic fluid. At the same time, the monostable 32 is energised which sets the counter 26 to zero. The pressure sensor 21 is also energised on actuation of the switch 23 and will either immediately close the pressure switch 24 if the pressure in the fluid portion 2 of the chamber 1 is below the predetermined value, or do so after a delay if the hydraulic fluid has been stored under pressure in order to provide a supply thereof as soon as the valve 18 is opened.

On closure of the pressure switch 24, the oscillator 25 is energised and a pulsed signal is fed to the counter 26 which begins to count the pulses. When the first pulse has been registered in the counter 26, the first AND gate 27 is enabled with the result that the first charge 13 is ignited through the associated igniter circuit 28 and igniter 15, the igniter circuit amplifying the output from the AND gate before passing it to the related igniter. Ignition of the propellant 14 generates gas under pressure so that the associated frangible disc 17 is broken and the gas enters the gas portion 3 of the chamber 1 and expands the bellows 4, thereby pressurising the hydraulic fluid in the portion 2 of the chamber and expelling the same through the outlet 6 and valve 18 to the required point of use. If the pressure of the hydraulic fluid increases beyond the value set into the pressure sensor 21, the pressure switch 24 opens and the oscillator 25 consequently de-energised, but not the counter 26, AND gates 27 and igniter circuits 28 whereby the counter does not lose the count already registered therein. It is recognised that there will be a delay between ignition of a charge 13 and the resulting increased pressurisation of the hydraulic fluid and the timing of the oscillator output pulses is regulated accordingly. If the first charge 13 fails to ignite, or, if ignited, fails to raise the pressure of the hydraulic fluid sufficiently to close the pressure switch 24, or when the pressure in the hydraulic fluid decays as the ignited charge expires, then the second pulse from the oscillator 25 is received by the counter 26 and the second AND gate 27 enabled with consequential ignition of the second charge 13. This process is repeated until all the charges 13 have been used in a predetermined order or until the initiation switch 23 is opened which arrests the described sequence of operation. This will reset the counter 26 so that if the switch 23 is subsequently reclosed, there will be a delay in pressurisation, and hence supply, of hydraulic fluid as the counter receives a sufficient number of pulses to enable the next AND gate 27. The disc 17 of each unignited charge 13 protects the latter from inadvertent ignition which might otherwise occur as a result of the hot gas generated by an ignited charge.

As the hydraulic fluid is expelled from the chamber 1, the bellows 4 expands and will eventually reach the position indicated in broken lines in FIG. 1. The bellows may be formed from a thin metal or from other material which is compatible with the gas and working fluid being handled by the system. If the pressure in the gas portion 3 of the chamber 1 exceeds a predetermined value, the pressure relief device 10 operates to release the excess pressure.

The system of FIGS. 1 to 5 may be modified in a number of ways without departing from the invention and may be designed to handle fuels or oxidants or any other required working fluid. The ignition control means 22 need not be digital as described but may, for example, be mechanical or electro-mechanical in nature. Also the charges 13 may be of a form different from that shown in FIG. 1 and FIGS. 6 to 7 show one alternative form in which the charges are individual capsules 34 threadedly received in the end cap 8 of the chamber 1 (not shown). The capsules 34 are arranged in a manner similar to that shown in FIG. 3 and comprise a casing 35 containing the solid propellant 14 and igniter 15 as before. Each capsule 34 is a gas-tight seal in the cap 8, using a sealing ring 36 (FIG. 8). The leads 37 to each igniter 15 are sealed in a plug 38 which itself is sealed into one end of the casing 35. Frangible discs 17 are provided as before.

A further alternative solid propellant charge arrangement is shown in FIG. 9, the slugs of propellant 39 being contained in the cap 8 and being of annular form stacked one next to the other although separated by metal discs 42 located by metal rings 43. The metal discs 42 have central apertures 44 which are aligned with one another and with the bore formed by the annular slugs 39. Heat reflective and conductive protection for the slugs 39 is provided as before as indicated at 45 and 46, respectively. The disc apertures 44 allow gas generated by a charge to flow into the gas portion 3 of the chamber 1 which is not shown in FIG. 9. The charges are provided with igniters 15 as before and are ignited serially in a manner similar to that already described in relation to FIGS. 1 to 5.

Instead of the bellows 4 shown in FIG. 1, the gas and fluid portions 3, 2 of the chamber 1 may be separated by a piston 47 as shown in FIG. 10, the piston effecting the necessary seal between the two chamber portions by sealing rings 48. The initial position of the piston 47 is shown in full lines and the final position on total expulsion of the working fluid shown in broken lines.

It will be seen that a fluid supply system in accordance with the present invention offers several advantages over existing fluid supply systems. The integration of a multi-charge solid propellant gas generator with fluid expulsion means gives rise to a compact system capable of supplying a working fluid at a high pressure. The individual solid propellant charges can be ignited serially as required, allowing the output of the system to vary from maximum to zero with no fuel wastage. The system therefore has a fully variable output whilst taking the intrinsic advantages of a solid propellant as an energy source, i.e. high energy density, long storage life and simplicity. The relatively small volume and mass makes the system particularly useful in aerospace applications. As already stated, the system may be designed to pressurise and expel various fluids such as hydraulic oils, water, oxidisers and fuels and can be sized to satisfy different fluid output demands.

We claim:

1. A fluid supply system comprising:

a chamber having an inlet means and an outlet means;

a container having an ignitable solid propellant, coupled to said chamber inlet means for providing a supply of pressurized gas;

a partition responsive to the pressurized gas, positioned to divide said chamber into at least a first portion for receiving the pressurized gas and a second portion for receiving a liquid; and means for controlling the ignition of the solid propellant, which includes a pressure sensor within said chamber and means for igniting the solid propellant in response to the pressure sensor.

2. A fluid supply according to claim 1 wherein the solid propellant is in the form of demountable charges having an igniter and a frangible member to separate the charges from the inlet means of said chamber.

3. A fluid supply system according to claim 2 wherein the frangible member includes a heat reflective layer and an insulative layer.

4. A fluid supply system according to claim 3 wherein the frangible member is a disc.

5. A fluid supply system according to claim 2 wherein the means for controlling ignition includes a switching means coupled to the pressure sensor and the ignition means, whereby the chamber pressure is maintained at selected pressures by the switching means actuating the ignition means in response to the pressure sensor.

6. A fluid supply system according to claim 5 wherein the means for controlling ignition further includes an oscillator rendered operative when the switching means is actuated, a counter responsive to the output of the oscillator, gate means responsive to the output of the counter and ignition circuits responsive to the respective outputs of the gate means; whereby the solid propellant charges are ignited serially.

7. A fluid supply system according to claim 6 wherein the counter remains energized but the oscillator does not when the switch means is deactuated, when the switch means is reactuated the serial ignition of the solid propellant is immediately resumed.

8. A fluid supply system according to claim 7 wherein the ignition circuits include an amplifier.

9. A fluid supply system according to claim 8 wherein said container is in the form of an end cap and includes an apertured member for separating the charges of solid propellant.

10. A fluid supply system according to claim 9 wherein said partition includes a bellows.

* * * * *